US006922858B1

(12) United States Patent
Shamie

(10) Patent No.: US 6,922,858 B1
(45) Date of Patent: Aug. 2, 2005

(54) HARDWARE SYSTEM FOR A CRIB

(76) Inventor: Louis Shamie, 114 W. 26th St., New York, NY (US) 10001

( * ) Notice: Subject to any disclaimer, the term of this patent is extended or adjusted under 35 U.S.C. 154(b) by 0 days.

(21) Appl. No.: 09/655,962

(22) Filed: Sep. 5, 2000

Related U.S. Application Data

(60) Provisional application No. 60/164,079, filed on Nov. 5, 1999.

(51) Int. Cl.[7] ..... A47D 7/02
(52) U.S. Cl. ..... 5/100
(58) Field of Search ..... 5/100, 93.1, 428

(56) References Cited

U.S. PATENT DOCUMENTS 6,175,974 B1 * 1/2001 Draheim ..... 5/100
2002/0157182 A1 * 10/2002 Guillot ..... 5/100

* cited by examiner

*Primary Examiner*—Alexander Grosz
(74) *Attorney, Agent, or Firm*—Arthur I. Degenholtz

(57) ABSTRACT

A crib includes a pair of lower guides which are mounted on lower portions of the headboards. When it is desired to lower the side rail of the crib, the side rail must first be raised to allow a steel pin to leave a locking slot and the side rail must then be pushed inwardly relative to the crib to overcome an integrally formed cantilever spring which normally blocks access to a guide slot which is formed in the lower guide. When the cantilever spring is pushed inwardly, the steel pin gains access to the guide slot and the steel pin can then slide downwardly thereby moving the side rail down.

19 Claims, 17 Drawing Sheets

HARDWARE SYSTEM FOR A CRIB

The present application is based on my U.S. Provisional Patent Application, Ser. No. 60/164,079, titled Hardware System For A Crib, filed Nov. 5, 1999.

FIELD OF THE INVENTION

The present application relates generally to the field of cribs and more particularly to a hardware system for a crib which can be easily and safely assembled without a need for tools and which can be easily operated with just one hand.

BACKGROUND OF THE INVENTION

Despite the various developments in the field of cribs there remains a need for a hardware system for a crib which is strong, safe, easy to assemble and relatively inexpensive.

OBJECTS AND SUMMARY OF THE INVENTION

It is an object of the present invention to provide a hardware system for a crib which can be assembled by a user without the need for tools of any kind.

Another object of the present invention is to provide a hardware system for a crib which can be easily operated with just one hand.

Another object of the present invention is to provide a hardware system for a crib in which the side rail cannot fall out.

Another object of the present invention is to provide a hardware system for a crib which meets all applicable safety standards.

Another object of the present invention is to provide a hardware system for a crib which provides for safe operation.

Another object of the present invention is to provide a hardware system for a crib which provides reliable long term operation.

Yet another object of the present invention is to provide a hardware system for a crib which comprises a relatively small number of component parts each of which can be manufactured economically resulting in a relatively low overall cost.

The foregoing and other objects and advantages of the invention will appear more clearly hereinafter.

In accordance with the present invention there is provided a hardware system for a crib which includes a pair of upper rail guides which are mounted on opposite ends of the upper rail of the side rail assembly of the crib. Each of the upper rail guides has a T-shaped steel pin which rides in a T-shaped slot which is formed in the upper guides which are mounted on each of the headboards of the crib.

A key feature of the present invention is the lower rail guide. A pair of lower guides are mounted on lower portions of the headboards. The lower rail guides each have a T-shaped steel pin. When the side rail is in the upper locked position, the steel pin enters a locking slot formed in the upper portion of the lower guides. When it is desired to lower the side rail of the crib, the side rail must first be raised to allow the steel pin to leave the locking slot and the side rail must then be pushed inwardly relative to the crib to overcome an integrally formed cantilever spring which normally blocks access to a guide groove which is formed in the lower guide. When the cantilever spring is pushed inwardly, the steel pin gains access to the guide slot and the steel pin can then slide downwardly thereby moving the side rail down. The cantilever spring and the lower guide are preferably integrally formed of plastic. When the side rail is raised, the steel pin pushes past the cantilever spring and then rides down a ramp to enter the locking slot.

The side rail can be easily operated with just one hand by raising the side rail with one hand and pushing the side rail inwardly with the knee.

The side rail is assembled to the headboard by inserting the steel pin into a T-shaped entrance slot which is formed in the lower guide thereby allowing the steel pin to enter the guide slot.

It should be understood that this T-shaped entrance slot can be positioned on the side of the guide slot as shown or on the bottom of the guide slot or on the top of the guide slot.

In an alternate embodiment of the invention, the upper rail guides are replaced by upper rail guides which have a pair of inwardly projecting flanges which engage the T-shaped upper guide.

DESCRIPTION OF THE DRAWINGS

Other important objects and advantages of the invention will be apparent from the following drawings in which.

DETAILED DESCRIPTION OF THE INVENTION

Figure 1:
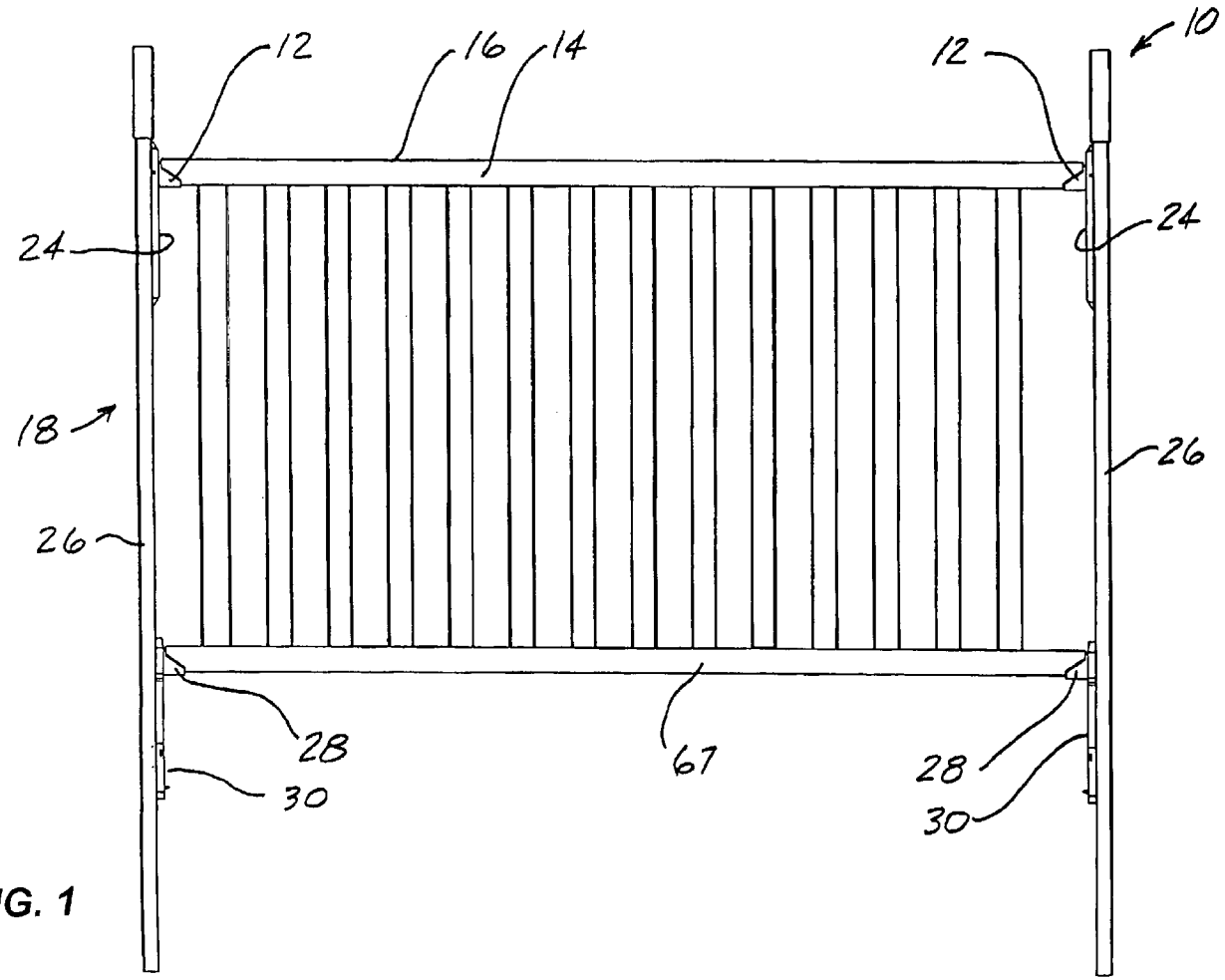
FIG. 1 is a side elevation view of a crib showing the installation of the hardware system for a crib according to the present invention.

With reference to the drawings, in which like reference numbers designate like or corresponding parts throughout, there is shown in FIG. 1 a hardware system for a crib, generally designated by reference number 10, made in accordance with the present invention, which includes: a pair of upper rail guides 12 which are mounted on opposite ends of the upper rail 14 of the side rail assembly 16 of a crib 18. Each of the upper rail guides 12 has a T-shaped steel pin 20 which rides in a T-shaped slot 22 which is formed in the upper guides 24 which are mounted on each of the headboards 26 of the crib 18. The upper guides 24 are best shown in FIGS. 6, 7, 8 and 9.

Figure 2:
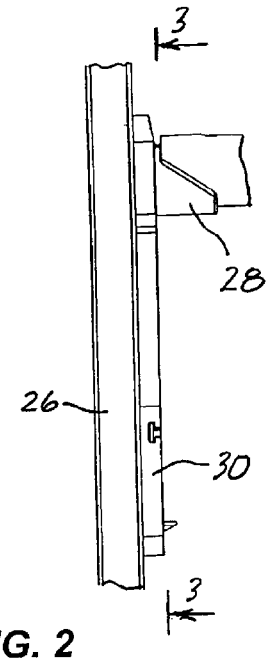
FIG. 2 is a fragmentary side elevation view drawn to an enlarged scale showing the attachment of the lower rail to the lower guide which is mounted on the left headboard.
Figure 3:
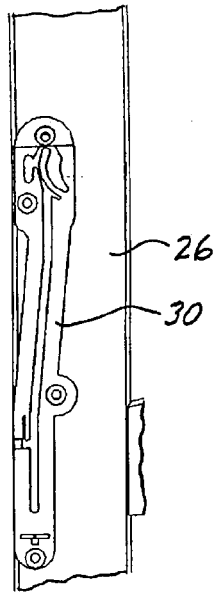
FIG. 3 is a fragmentary elevation view taken along the line 3—3 of FIG. 2.
Figure 4:
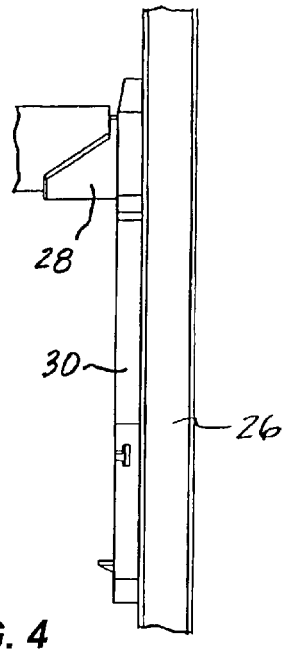
FIG. 4 is a fragmentary side elevation view drawn to an enlarged scale showing the attachment of the lower rail to the lower guide which is mounted on the right headboard.
Figure 13:
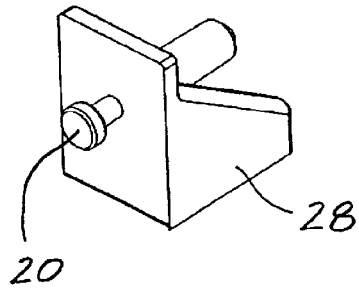
FIG. 13 is a perspective view of the lower rail guide.
Figure 14B:
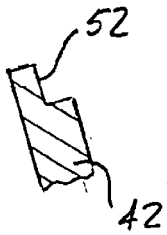
FIG. 14B is a fragmentary cross-sectional view taken along the line 14B—14B of FIG. 14.
Figure 14:
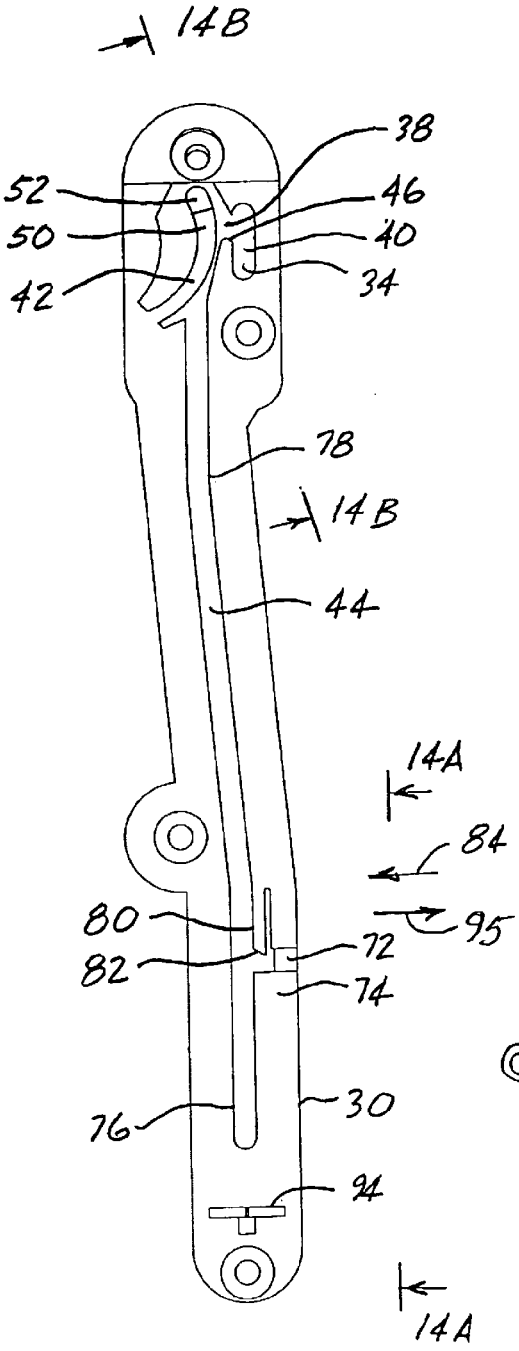
FIG. 14 is a rear elevation view of the lower guide.
Figure 14C:
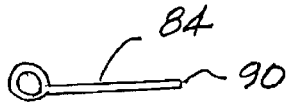
FIG. 14C is an elevation view of a release pin for use on the lower guide.
Figure 14A:
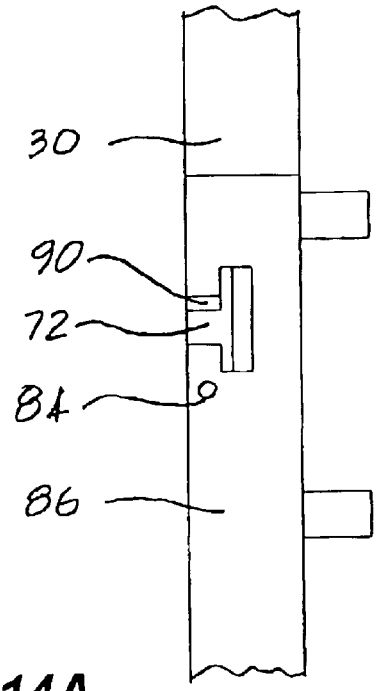
FIG. 14A is a side view taken along the line 14A—14A of FIG. 14.

A key feature of the present invention is the lower rail guide 28 and the lower guide 30. The lower rail guides 28 are best shown in FIGS. 2, 14 and 13.

The upper and lower rail guides 12 and 28 are identical.

Figure 5:
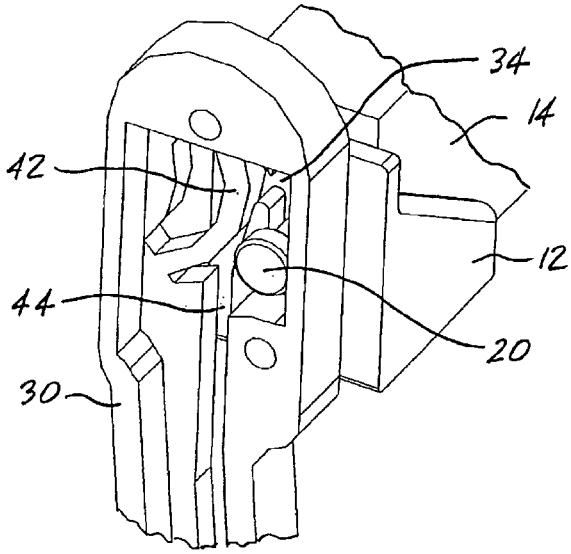
FIG. 5 is a fragmentary perspective view showing the lower guide removed from the headboard and showing the steel pin of the lower rail guide positioned in the locking slot, with the lower rail guide in the upper and locked position and showing the cantilever plastic spring covering the guide slot.
Figure 6:
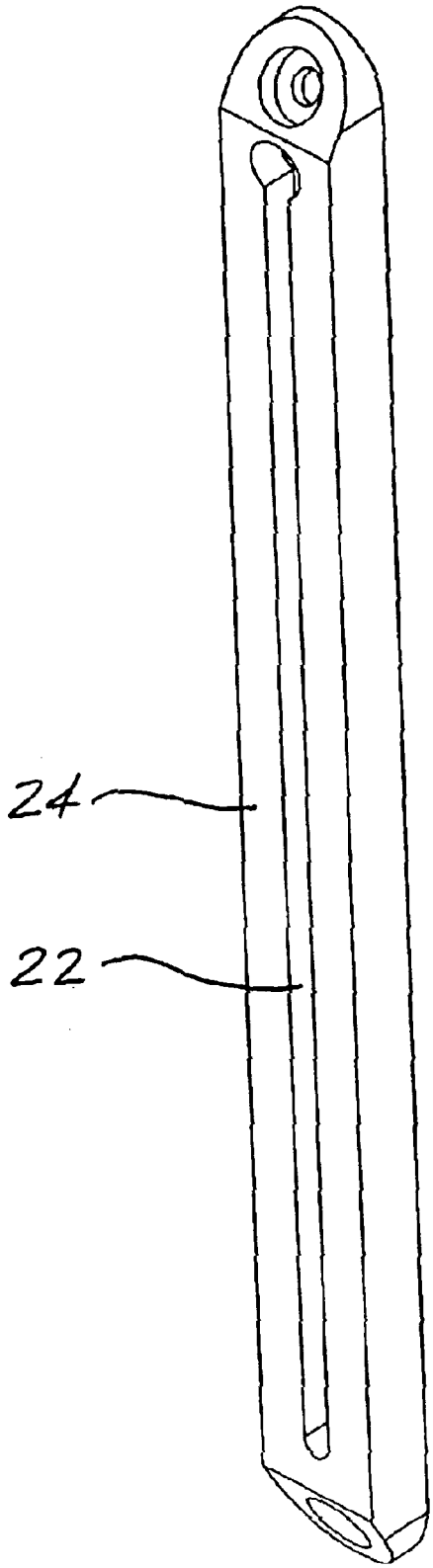
FIG. 6 is a perspective view of the upper guide.
Figure 9A:
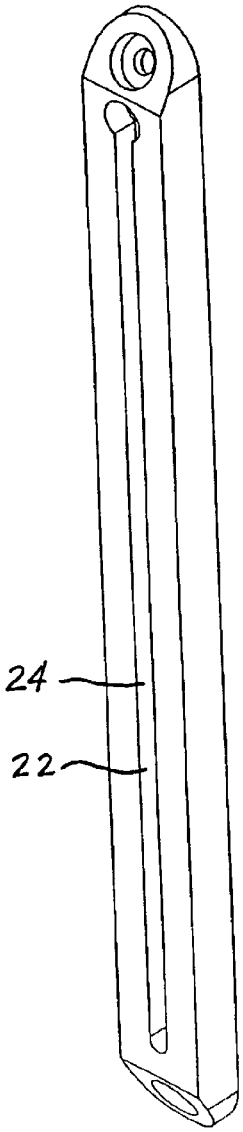
FIG. 9A is a perspective view of the upper guide.
Figure 7:
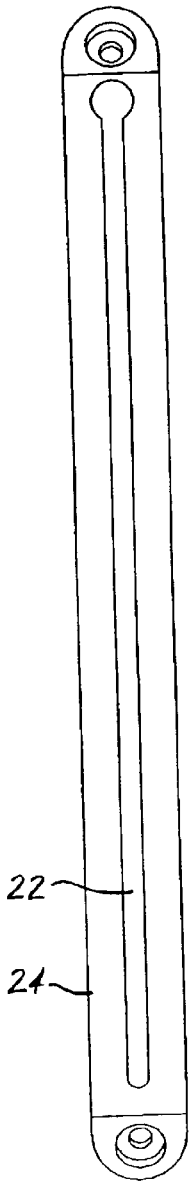
FIG. 7 is a front elevation view of the upper guide.
Figure 9:
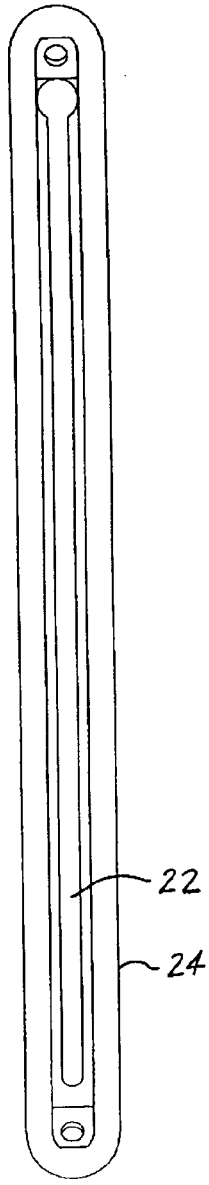
FIG. 9 is a rear elevation view of the upper guide.
Figure 8:
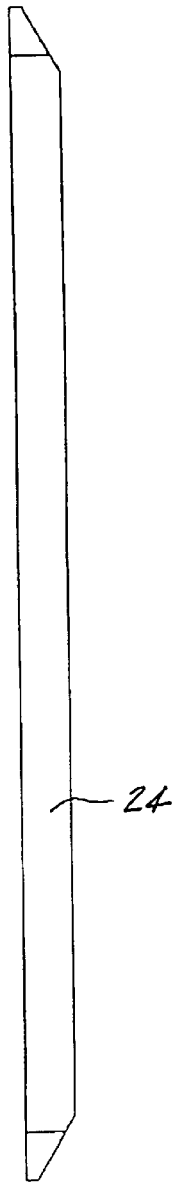
FIG. 8 is a side elevation view of the upper guide.
Figure 10:
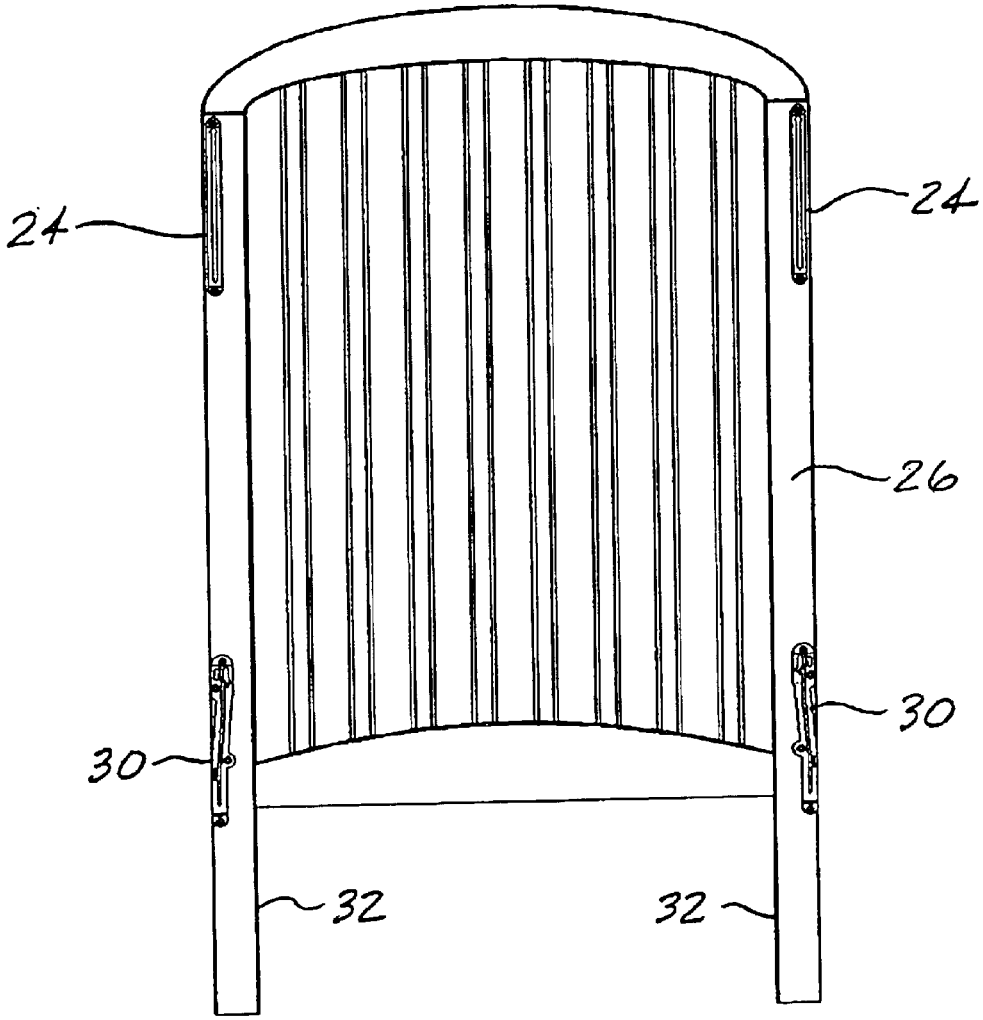
FIG. 10 is a elevation view of the headboard with the headboard shown removed from the crib with the headboard shown as shipped from the factory with the upper rail guide and the lower rail guide in place.
Figure 11:
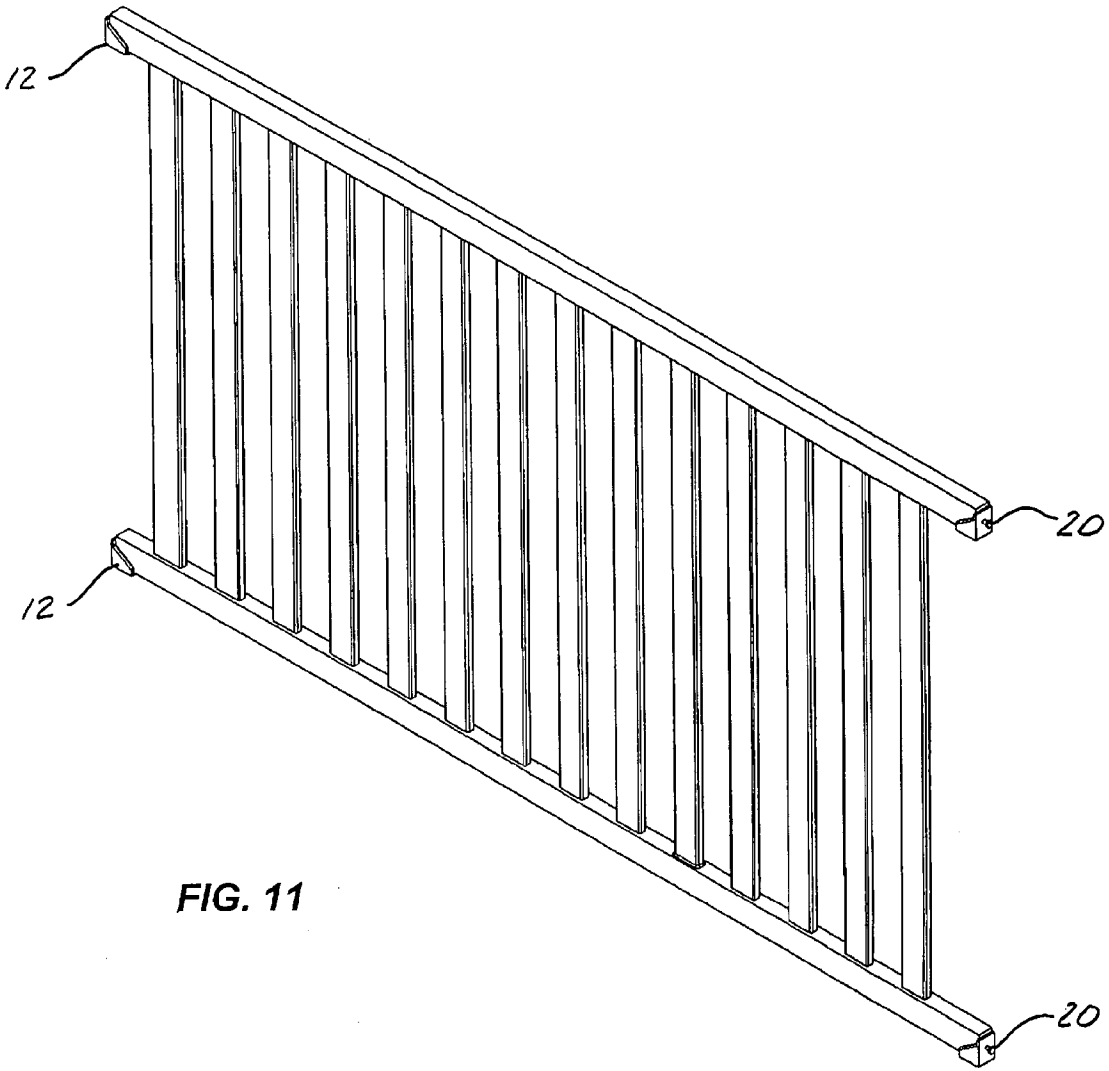
FIG. 11 is a perspective view of the side rail assembly.
Figure 12:
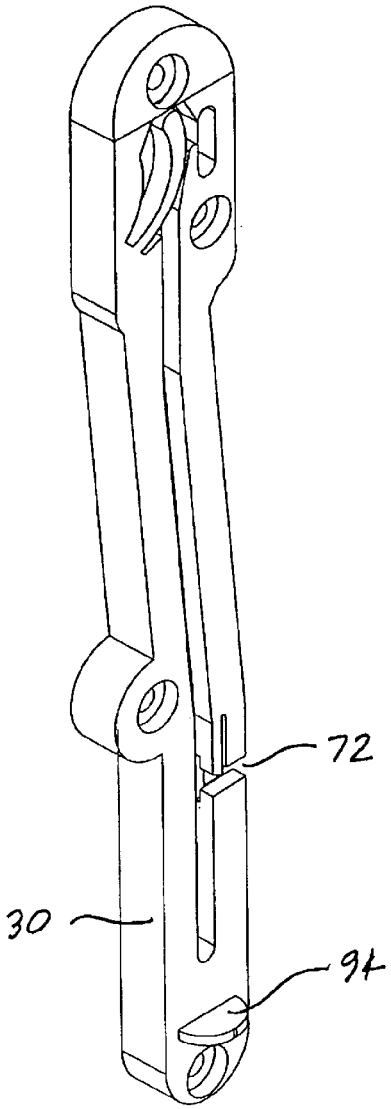
FIG. 12 is a perspective view of the lower guide.

A pair of lower guides 30 are mounted on lower portions 32 of the headboards 26. The lower rail guides 28 each have a T-shaped steel pin 20. When in the upper locked position, the steel pin 20 enters a locking slot 34 formed in the lower guide 30 as is best shown in FIG. 5. The locking slot 34 is formed by a first aperture 38 which communicates with a second aperture 40 as is shown in FIG. 14.

When it is desired to lower the side rail 16 of the crib 18, the side rail 16 must first be raised to allow the steel pin 20 to leave the locking slot 34 and the side rail 16 must then be pushed inwardly relative to the crib 18 to overcome an integrally formed cantilever spring 42 which normally blocks access to a guide slot 44 which is formed in the lower guide 30. When the cantilever spring 42 is pushed inwardly the steel pin 20 gains access to the guide slot 44 and the steel pin 20 can then slide downwardly thereby moving the side rail 16 down. The cantilever spring 42 is preferably integrally molded as part of the lower guide 30 which is made of plastic.

When the side rail 16 is raised, the steel pin 20 pushes past the cantilever spring 42 and then rides down a ramp 46 to enter the locking slot 34.

The details of construction of the lower guide 30 are best shown in FIGS. 14, 14A, 14B, 15, 15A, 15B and 15C. The integrally molded cantilever spring 42 projects upwardly from the portion 48 of the lower guide 30. The upper end 50 of the cantilever spring 42 has a step portion 52 which moves into a recess portion 54 when the pin 20 moves upwardly, in the direction of the arrow 56 in FIG. 15B, thereby deflecting the cantilever spring 42 in the direction shown by the arrow 58 in FIG. 15B. The deflected position of the cantilever spring 42 is shown in broken lines 60 in FIG. 15B. The recess portion 54 is defined in part by an integrally molded safety wall 62. The safety wall 62 prevents excessive deflection of the cantilever spring 42 in the direction shown by the arrow 64 in FIG. 15A and thereby prevents overstressing the cantilever spring 42. The safety wall 62 prevents the steel pin 20 from leaving the guide 30.

Figure 15C:
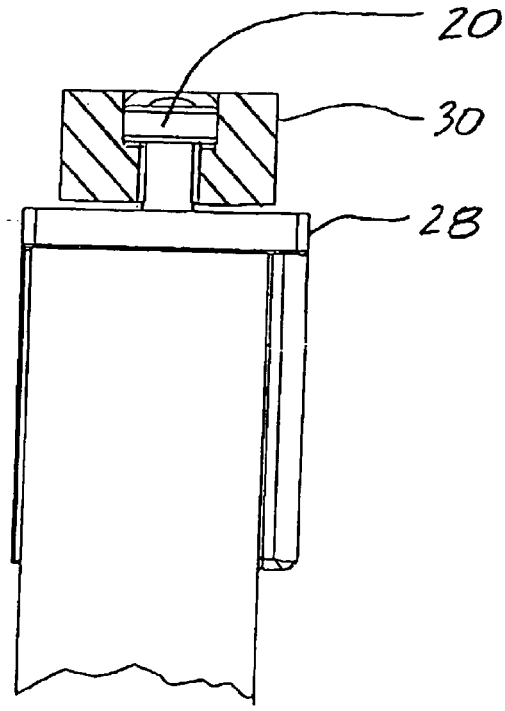
FIG. 15C is a cross-sectional view taken along the line 15C—15C of FIG. 15.
Figure 15:
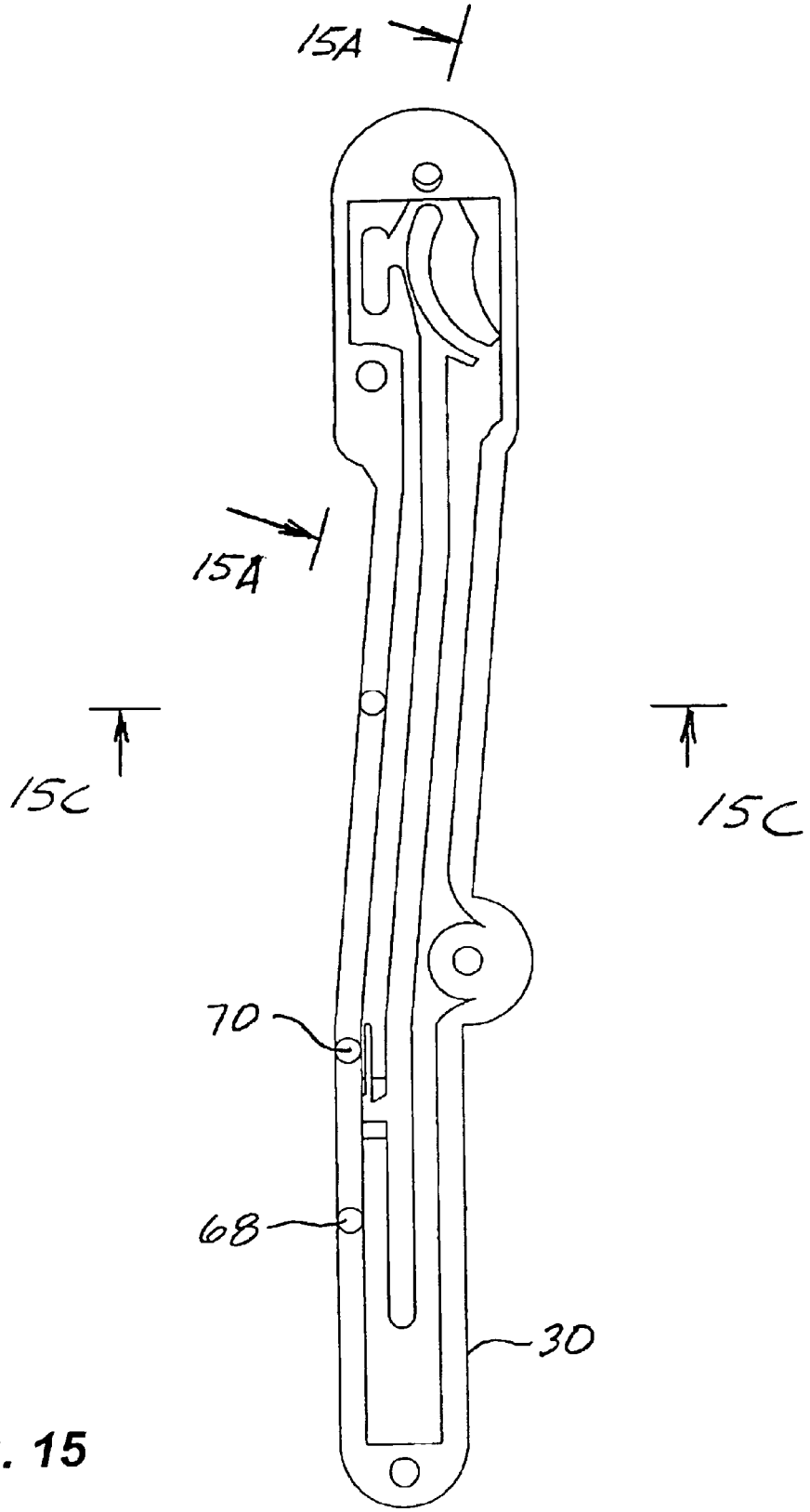
FIG. 15 is a front elevation view of the lower guide.
Figure 15A:
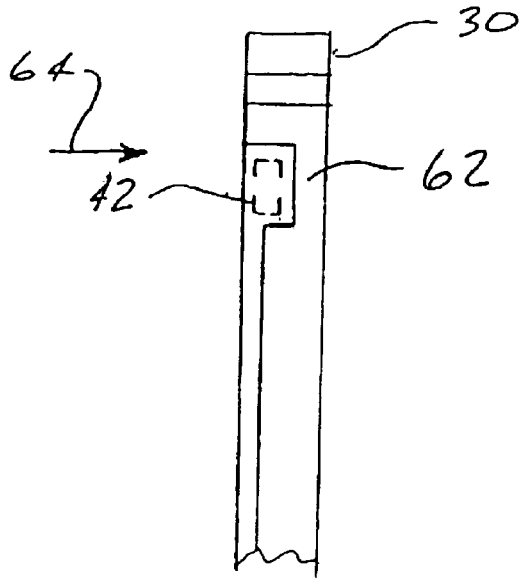
FIG. 15A is a fragmentary cross-sectional view taken along the line 15A—15A of FIG. 15.
Figure 15B:
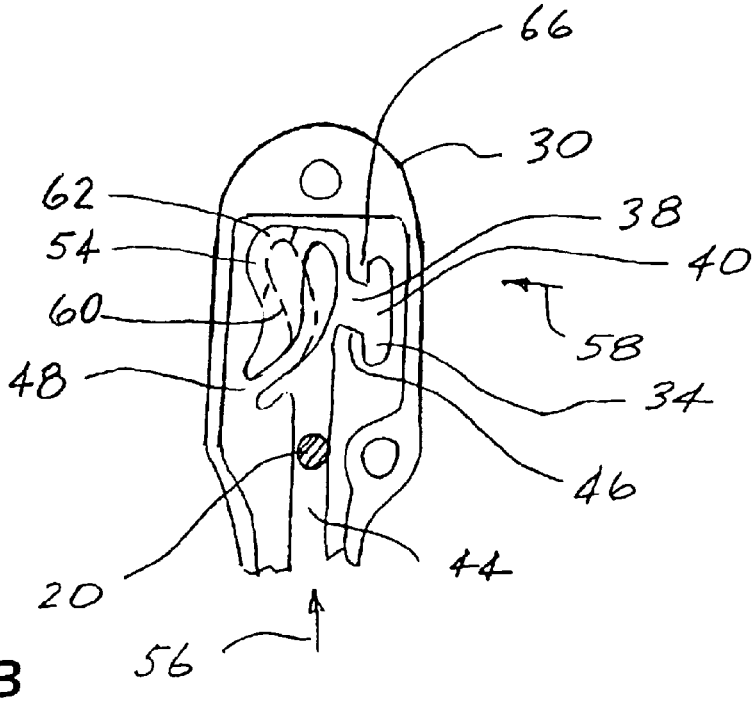
FIG. 15B is a fragmentary view similar to FIG. 15 showing the deflected position of the cantilever spring in broken lines.
Figure 16:
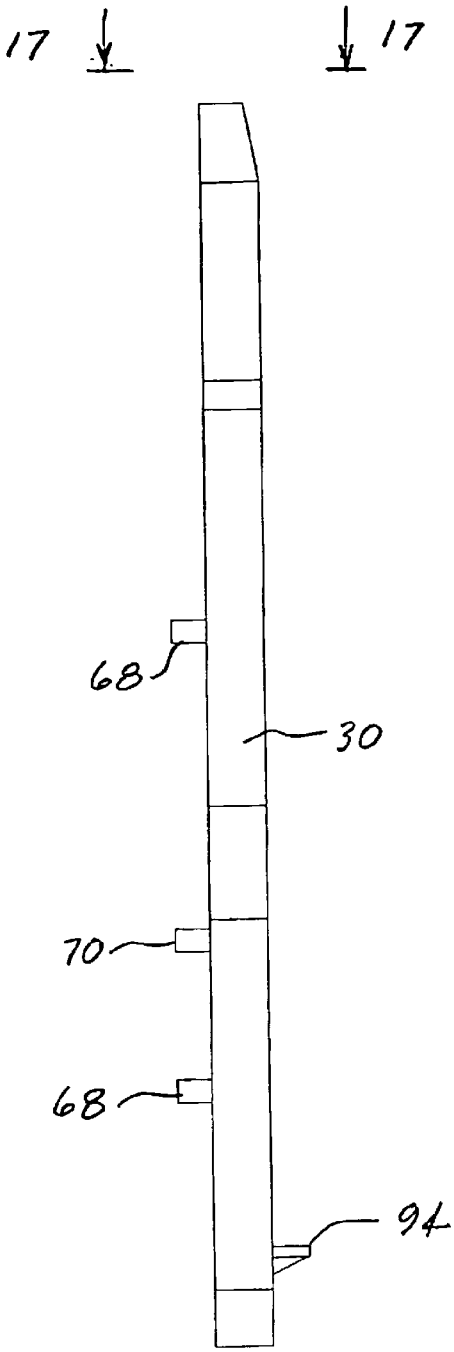
FIG. 16 is a side elevation view of the lower guide.
Figure 17:
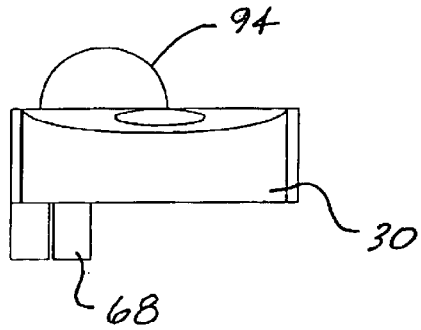
FIG. 17 is an end elevation view of the lower guide.
Figure 22:
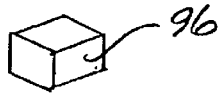
FIG. 22 is a perspective view of a rubber bumper.
Figure 19:
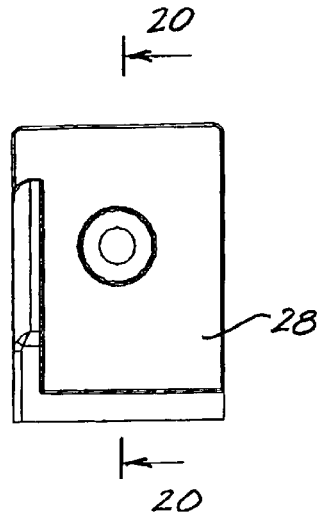
FIG. 19 is a top plan view of the lower guide.
Figure 21:
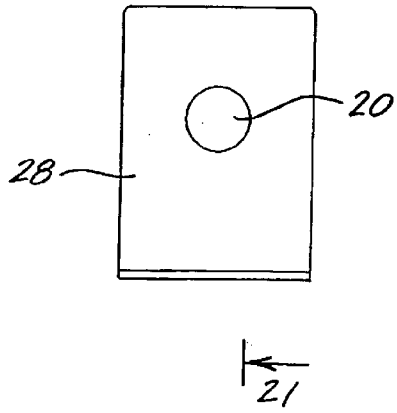
FIG. 21 is a plan view taken along the line 21—21 of FIG. 20.
Figure 20:
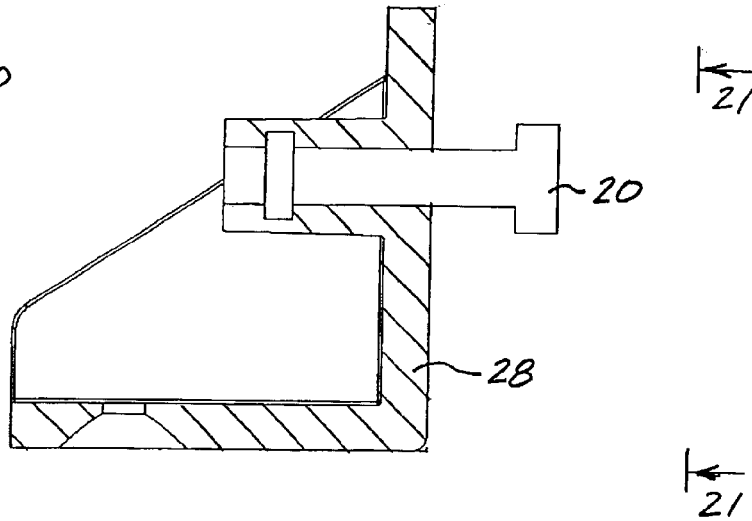
FIG. 20 is a cross-sectional view taken along the line 20—20 of FIG. 19.
Figure 18:
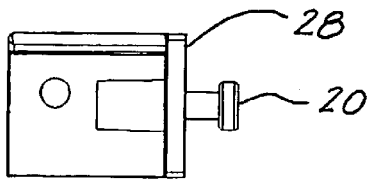
FIG. 18 is a bottom plan view of the lower guide.

As is shown in FIG. 15B when the side rail 16 and the steel pin 20 are lifted, the steel pin 20 enters the aperture 38 and rides down the ramp 46 to enter the aperture 40. The ramp 46 has a dual function. When the side rail 16 is raised, the ramp 46 allows the steel pin 20 to easily ride down into the aperture 40. When the side rail 16 is to be lowered, the ramp 46 allows the steel pin 20 to ride up the ramp 46 to a position in contact with the cantilever spring 42 whereby pressure in the direction shown by the arrow 56, in FIG. 15B causes the pin 20 to deflect the cantilever spring 42 thereby allowing the pin 20 to enter the slot 44.

The apertures 38, 40 form the general configuration of a capital letter T. The portion 66 of the lower guide 30, adjacent to the aperture 38 forces a user to raise the side rail 16 and then lower the side rail 16 slightly thereby allowing the pin 20 to enter the aperture 38. This relatively complex motion required by the present invention 10 of raising the side rail 16 and then slightly lowering the side rail provides an additional measure of safety while allowing the operation of the crib 18 to be performed with one hand.

The side rail 16 can be easily operated with just one hand by raising the side rail 16 with one hand and pushing the bottom 67 of the side rail 16 inwardly with the knee.

The lower guide 30 includes a pair of projecting pins 68, 70 which cooperate with complementary holes in the headboard 26 to prevent flexing of the lower guide 30 and thereby maintain the free running of the pin 20 in the slot 44.

The side rail 16 is assembled to the headboard 26 by inserting the steel pin 20 into a T-shaped entrance slot 72 which is formed in the lower guide 72 thereby allowing the steel pin 20 to enter the guide slot 44.

It should be understood that this T-shaped entrance slot 72 can be positioned on the side 74 of the guide slot 44 as shown or on the bottom 76 of the guide slot 44 or on the top 78 of the guide slot 44.

The T-shaped entrance slot 72 has an integrally formed locking cantilever spring 80. The locking cantilever spring 80 has an end 82 which projects into the slot 72. When the side rail 16 is assembled to the headboard 26 the steel pin 20 is pushed past the locking cantilever spring 80 thereby entering the guide slot 44.

When it is desired to remove the side rail 16 a release pin 84 is pushed into a hole 86 formed on the surface 88. As the pin 84 is pushed into the hole 86 to end 90 of the pin bears against the cantilever spring 90 bending the cantilever spring 80 in an inward direction as shown by the arrow 84 in FIG. 14 and moving the tip 82 of the cantilever spring 80 inwardly sufficiently to allow the tip 82 to clear the slot 72 thereby allowing the steel pin 20 to move out in the direction shown by the arrow 95 in FIG. 14. The lower guide 30 includes a stop 94 which supports a rubber bumper 96.

Figure 23:
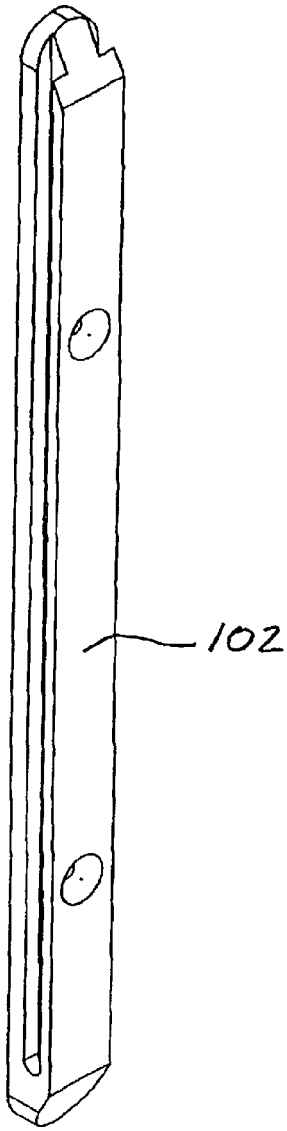
FIG. 23 is a perspective view of an alternative upper guide.
Figure 24:
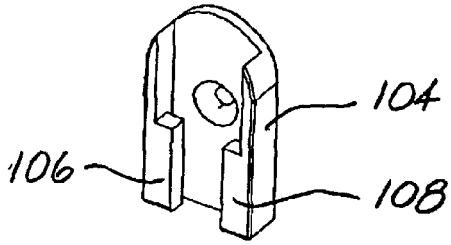
FIG. 24 is a perspective view of an alternative upper rail guide.

In an alternate embodiment of the invention the upper guides 24 are replaced by alternative upper guides 102 one of which is shown in FIG. 23 and the upper rail guides 12 are replaced by the upper rail guides 104 as is shown in FIG. 24. The lower guides 30 and the lower rail guides 28 are as described above. The upper rail guide 104 has a pair of inwardly projecting flanges 106, 108 which engage the T-shaped upper guide 102.

In the primary embodiment of the invention 10 the lower guide 30 and the cantilever spring 42 are made of plastic.

Figure 25:
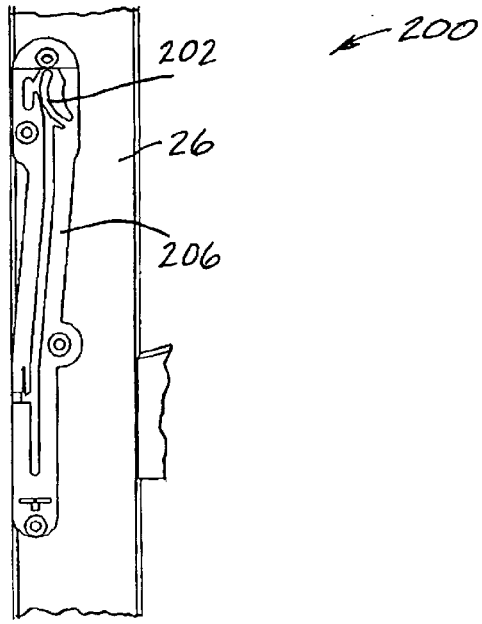
FIG. 25 is an elevation view of an alternative lower guide which incorporates a metal spring.
Figure 26:
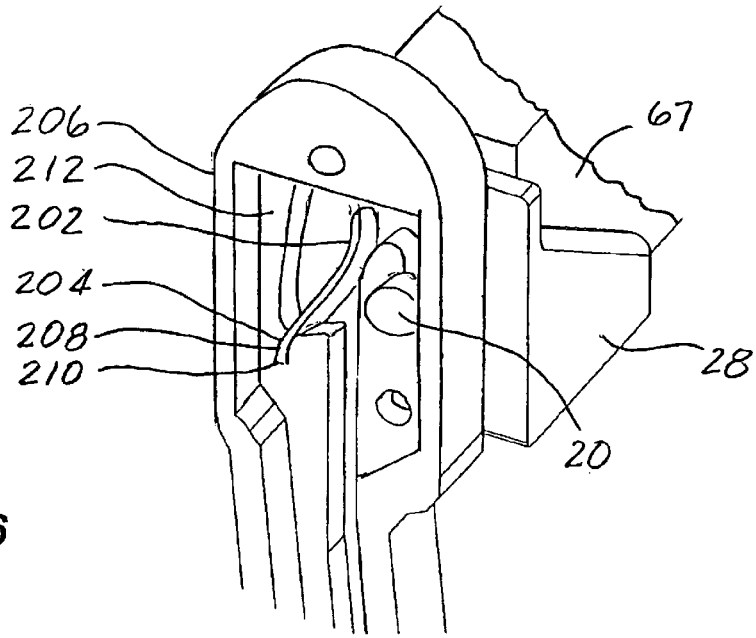
FIG. 26 is a fragmentary perspective view of the alternative lower guide of FIG. 25 showing the details of construction of the metal spring and showing the side rail assembly in the upper locked position.

FIGS. 25 and 26 show an alternative embodiment of the invention 200 which incorporates a metal cantilever spring 202. The spring 202 is mounted in a slot 204 which is formed in the lower guide 206. The first end 208 of the spring 202 is bent to form a tab 210 which helps retain the spring 202 in the slot 204. The spring 202 operates in the manner previously described in connection with the spring 42 to retain the pin 20.

Figure 27:
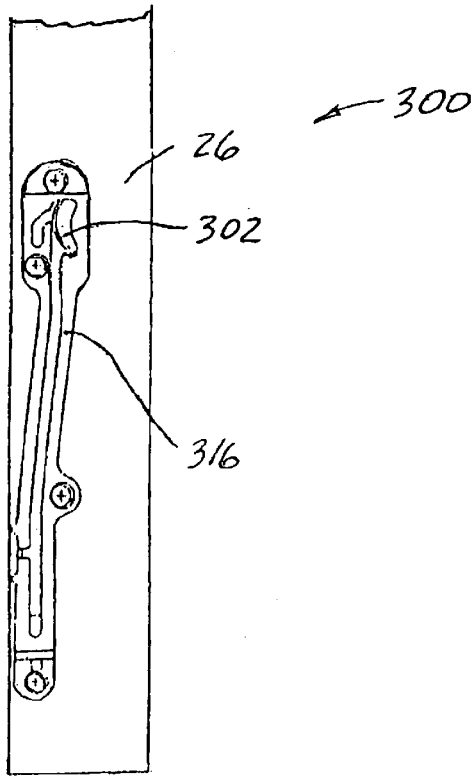
FIG. 27 is an elevation view of an alternative lower guide which incorporates an alternative metal spring.
Figure 28:
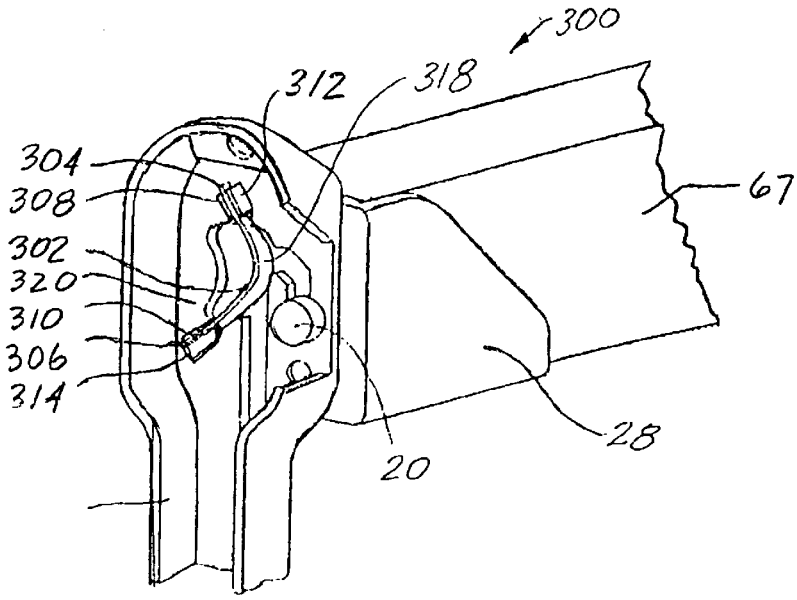
FIG. 28 is a fragmentary perspective view of the alternative lower guide of FIG. 27 showing the details of construction of the alternative metal spring and showing the side rail assembly in the upper locked position.
Figure 29:
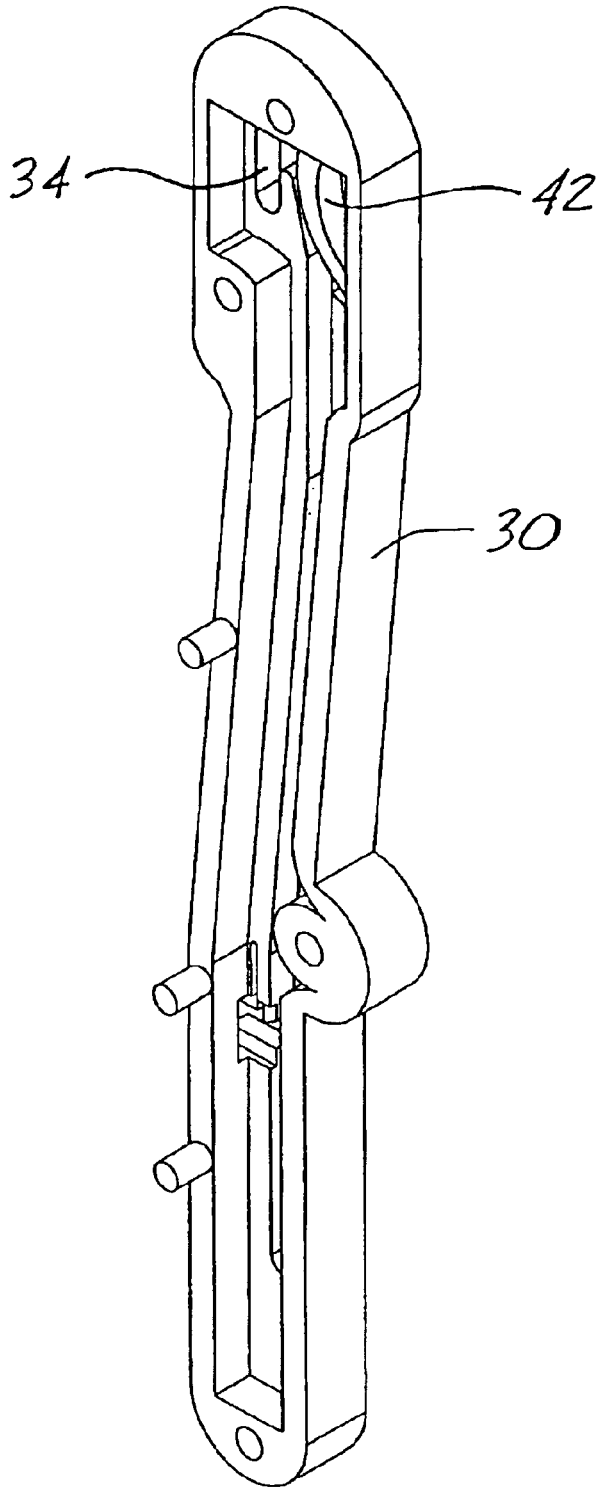
FIG. 29 is a perspective view of the lower guide.

FIGS. 27 and 28 show an another alternative embodiment of the invention 300 which incorporates a metal leaf spring 302. The first and second ends 304, 306 of the spring 302 are mounted in slots 308, 310 which are formed in supports 312, 314 which are formed on the lower guide 316. The center portion 318 of the spring 302 operates in the manner previously described in connection with the spring 42 to retain the pin 20.

The springs 202, 302 are behind and not in the planes of walls 212, 320 of the guides 206, 316, respectively.

The foregoing specific embodiments of the present invention as set forth in the specification herein are for illustrative purposes only. Various deviations and modifications may be made within the spirit and scope of this invention without departing from the main theme thereof.

What is claimed is:

1. A guide (30) for a crib comprising:

a base with a first slot (44) formed in said base with said first slot (44) having a periphery, a second slot (38) formed in said base and a third slot (40) formed in said base communicating with said first and said second slots, with said base having an outer edge;

a first spring (42) mounted on said base and disposed blocking said second slot (38).

2. The guide (30) for a crib of claim 1 in which said first spring (42) comprises:

a cantilever spring having a first end mounted on said base and a second end.

3. The guide (30) for a crib of claim 2 further comprising:

a recess portion (54) formed in said base disposed to receive said second end of said first spring.

4. The guide (30) for a crib of claim 2 further comprising:

a step portion (52) formed on said second end of said first spring (42).

5. The guide (30) for a crib of claim 4 further comprising:

a wall (62) disposed proximate said step portion (52).

6. The guide (30) for a crib of claim 2 in which said first spring (42) comprises:

a metal cantilever spring.

7. The guide (30) for a crib of claim 2 in which said first spring (42) comprises:

a plastic cantilever spring.

8. The guide for a crib of claim 2 in which said first spring (42) comprises:

a leaf spring (318).

9. The guide (30) for a crib of claim 1 further comprising a ramp portion (46) formed in said second slot (38).

10. The guide (30) for a crib of claim 1 further comprising:

a T-shaped slot (72) communicating between said first slot (44) and said outer edge.

11. A crib (10) comprising:

headboard (26), a side rail (16), an elongated upper guide (24), sliding means (20) mounted on said side rail for engagement of said upper guide, a lower guide (30) comprising:

a base with a first slot (44) formed in said base with said first slot having a periphery, a second slot (38) formed in said base and a third slot (40) formed in said base communicating with said first and said second slots, with said base having an outer edge;

a first cantilever spring (42) disposed projecting from said base and disposed blocking said second slot with said cantilever spring having a tip.

12. The crib of claim 11 further comprising:

a least one pin (68) projecting from said base of said lower guide (30) and disposed engaging said headboard.

13. The crib of claim 11 in which said sliding means mounted on said side rail comprises:

a pin (20) projecting from said side rail and engaging said elongated upper guide.

14. The crib of claim 11 in which said sliding means mounted on said side rail (16) comprises:

a pair of flanges (106) (108) with said flanges engaging said elongated upper guide (102).

15. A guide (30) for a crib comprising:

a base with a first slot (44) formed in said base with said first slot (44) having a periphery, a second slot (38) formed in said base and a third slot (40) formed in said base communicating with said first and said second slots, with said base having an outer edge;

a first spring (42) mounted on said base and disposed blocking said second slot (38)

with said first spring (42) comprising:

a cantilever spring having a first end mounted on said base and a second end, with said guide (30) further comprising:

a step portion (52) formed on said second end of said first spring (42) and a wall (62) disposed proximate said step portion (52).

16. A guide (30) for a crib comprising:

a base with a first slot (44) formed in said base with said first slot (44) having a periphery, a second slot (38) formed in said base and a third slot (40) formed in said base communicating with said first and said second slots, with said base having an outer edge;

a first spring (42) mounted on said base and disposed blocking said second slot (38)

further comprising:

a T-shaped slot (72) communicating between said first slot (44) and said outer edge.

17. The guide (30) for a crib of claim 16 further comprising:

a second spring (80) projecting from said base and comprising an end disposed projecting into said T-shaped slot (72).

18. The guide (30) for a crib of claim 16 further comprising:

an aperture portion (90) formed in said base, disposed proximate and in general alignment with said end (82) of said second spring (80).

19. A guide (30) for a crib comprising:

a base with a first slot (44) formed in said base with said first slot (44) having a periphery, a second slot (38) formed in said base and a third slot (40) formed in said base communicating with said first and said second slots, with said base having an outer edge;

a resilient portion (42) integrally formed on said base and disposed blocking said second slot (38).

* * * * *